US005222606A

United States Patent [19]

Ghini et al.

[11] Patent Number: 5,222,606

[45] Date of Patent: Jun. 29, 1993

[54] DEVICE FOR FEEDING CIGARETTES TO THE WRAPPING LINE OF A PACKAGING MACHINE

[75] Inventors: Marco Ghini, S.Lazzaro di Savena; Alessandro Minarelli, Bologna, both of Italy

[73] Assignee: G.D. S.p.A., Bologna, Italy

[21] Appl. No.: 846,891

[22] Filed: Mar. 6, 1992

[30] Foreign Application Priority Data

Mar. 8, 1991 [IT] Italy ..... B091A/000063

[51] Int. Cl.[5] ..... B07C 5/00

[52] U.S. Cl. ..... 209/535; 209/643; 131/907

[58] Field of Search ..... 209/535, 536, 537, 643; 131/907, 908, 280, 282, 283; 221/200, 204, 205, 134

[56] References Cited

U.S. PATENT DOCUMENTS 2,991,879 7/1961 Innocenti ..... 209/535
3,568,884 3/1971 Petticek ..... 221/307
4,592,470 6/1986 Mattei et al. .
5,018,539 5/1991 Gamberini et al. ..... 209/535

FOREIGN PATENT DOCUMENTS 1298785 12/1972 United Kingdom .
2023994 1/1980 United Kingdom .

*Primary Examiner*—H. Grant Skaggs
*Attorney, Agent, or Firm*—Cushman, Darby & Cushman

[57] ABSTRACT

In a feed device comprising a chute divided into channels through which the cigarettes descend intermittently in stacks on their way to a wrapping line, the quality of the single cigarettes is controlled by sensors associated with the chute, whereupon any substandard cigarettes are ejected by a device interlocked to the sensors. The loose cigarettes are retained and aligned inside the channels by an alternating mechanism stationed above the ejection device, which is able to adjust the axial position of the cigarettes in relation to the sensors and to generate an axial supporting action, applied cyclically to the part of the descending stack immediately above the ejection station, of which the timing is fixed in relation to the operating cycle of the ejection device.

3 Claims, 1 Drawing Sheet

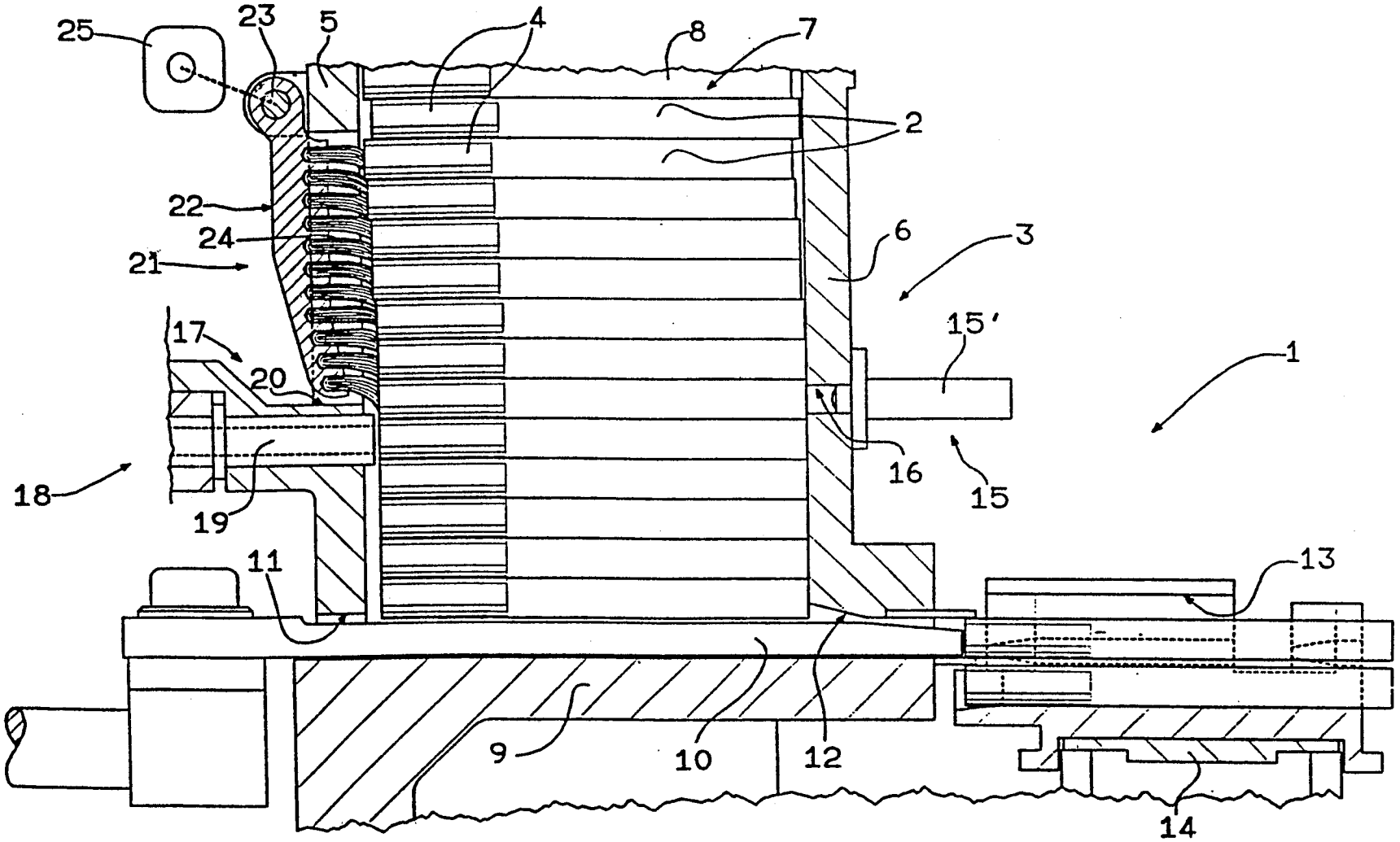
1
2
3
4
5
6
7
8
9
10
11
12
13
14
15
15'
16
17
18
19
20
21
22
23
24
25

DEVICE FOR FEEDING CIGARETTES TO THE WRAPPING LINE OF A PACKAGING MACHINE

BACKGROUND of the INVENTION

The present invention relates to a device by means of which cigarettes are fed to the wrapping line of a packaging machine.

Conventionally, in most instances, cigarettes are supplied to a packaging machine by way of a chute, conveyed either in special containers, or on a belt in a continuous stream.

The cigarettes emerge from the chute gathered into groups, each one of which comprises a number of single cigarettes corresponding to the intended contents of a finished packet.

Thereafter, the quality of the cigarettes of each group is controlled, and any groups containing even one defective cigarette are discarded as reject. To the end of reducing the number of the groups of cigarettes rejected, and thus achieve a considerable economic benefit, use is made of a quality control device as disclosed in U.S. Pat. No. 4,592,470 to verify the integrity of the single cigarettes contained in the chute and reject any defective items before their arrival at the grouping station.

The chute of a conventional machine is divided at the bottom end into essentially vertical channels which are substantially identical in width to the diameter of the single cigarette and equal in number to the number of cigarettes making up one group.

The previously patented control device in question comprises an element, associated with each channel, by means of and an element by which any defective cigarette is ejected.

In the case of conventional control devices, the cigarettes often will not always occupy the control station positioned in the same manner relative to the respective monitoring element, and the weight bearing down on the cigarettes at the reject point is such as to hinder the action of the components which effect the ejection.

SUMMARY OF THE INVENTION

The object of the present invention is to provide a device for feeding cigarettes to the wrapping line of a packaging machine which comprises a monitoring and rejection system of the aforementioned previously patented type, but which also remains free of the drawbacks associated with prior art embodiments, as outlined above.

The stated object is achieved, according to the invention, in a device for feeding cigarettes to the wrapping line of a packaging machine comprising an infeed chute from which cigarettes are directed toward the machine, divided at bottom by partitions into a plurality of channels each substantially equal in width to the diameter of one cigarette, through which corresponding stacks of cigarettes are caused to descend intermittently, also sensing means associated with each channel by which to monitor the integrity of successive cigarettes, and a device interlocked to the sensing means by which defective cigarettes are ejected from the chute. The device disclosed additionally comprises means operating above the level of the ejection device, which serve to retain and position the cigarettes internally of the channels and to position them axially in relation to the sensing means, and, advantageously, to generate an axial supporting action applied cyclically to the cigarettes lying above the level of the ejection device, of which the timing is fixed in relation to the operating cycle of the ejection device.

BRIEF DESCRIPTION of the DRAWINGS

The invention will now be described in detail, by way of example, with the aid of the accompanying drawing, in which, in the sole figure, the feed device is illustrated in a side elevation, partly in section.

DESCRIPTION of the PREFERRED EMBODIMENTS

In the drawing, numeral 1 denotes a feed device, in its entirety, by which cigarettes 2 are directed onto the wrapping line (not illustrated) of a packaging machine (not illustrated).

The device in question comprises a infeed chute 3, conventional in embodiment, designed to accommodate cigarettes 2 with a filter tip 4.

The chute 3 comprises a left wall 5 on the side nearest to the filters 4, and a right wall 6, which are disposed vertically and mutually parallel in such a way as to create a compartment of depth marginally greater than the length of one cigarette 2.

The compartment, in turn, is divided into channels 7 (one only appears in the drawing) by baffles or partitions 8, spaced apart one from the next at a distance marginally greater than the diameter of one cigarette 2. The channels 7 are stopped at the extreme bottom end by a horizontal base 9 on which the stack of cigarettes 2 occupying each channel 7 is brought to rest.

Numeral 10 denotes a push-rod element positioned to impinge on the cigarettes 2 in successive groups, which is reciprocated in a direction normal to the walls 5 and 6 of the chute within a plane adjacent to the base 9, passing through horizontal slots 11 and 12 of height substantially equal to the diameter of one cigarette 2, afforded by the respective walls 5 and 6.

Such an element 10 is capable of movement from an at-rest position located externally of the chute 3, to an operating position located internally of the chute 3, in such a way as to push the cigarettes 2 from the channels 7 into containers 13 (one only of which is illustrated) carried by an intermittently driven conveyor belt 14, which provide the means whereby the cigarettes 2 are transferred to the wrapping line.

A more detailed description of the construction of the chute 3, channels 7, push-rod element 10 and conveyor belt 14 is provided by the specifications and drawings of UK patents 1,298,785 and 2,023,994. Numeral 15 denotes a device, in its entirety, positioned in the right hand wall 6 of the chute and associated with each channel 7, by means of which to monitor the integrity of the single cigarettes 2.

Such a device is illustrated schematically in the drawing as a sensor 15' (optical, or mechanical, or pneumatic) capable of detecting any defect that may be presented by the end of each single cigarette 2, through a horizontal hole 16 afforded by the side wall 6.

Numeral 17 demotes an eject station occupying a level below that of the monitoring device 15 and equipped with an ejection device, denoted 18 in its entirety, by means of which any substandard cigarettes 2 will be removed from the chute.

The device 18 in question comprises a plurality of conventional pneumatic extraction ducts 19, one to each of the channels 7, of which a full description is given in Italian patent application 3348 A/89; accordingly, no further description is included in the present specification.

The left wall 5 of the chute will be seen to provide an opening 20, immediately above the eject station 17, through which each channel 7 is made accessible to retaining and positioning means, which are denoted 21 in their entirety.

Such means 21 comprise pressure means including a substantially vertical support 22, associated uppermost with a horizontally disposed pivot 23 mounted rotatably to the wall 5 and at right angles to the axes of the single cigarettes 2 occupying the channels 7.

The surface of the support 22 directed toward the interior of the channel 7 is faced with a readily deformable material embodied, in the particular example illustrated, as a plurality of fibres or bristles 24 disposed substantially parallel to the longitudinal axes of the cigarettes 2. The bristles 24 project a given distance into the relative channel 7 in such a manner as to interfere with the filter tips 4 of the cigarettes 2.

The pivot 23 is connected to an actuator element 25 and thereby provided with oscillating movement of which the frequency is identical to that of the reciprocation of the push-rod element 10, and the timing dependent upon the cycle ultimately operated by the push-rod element 10.

In operation, the integrity of the cigarettes 2 is verified by the sensors 15' with each pause in the machine cycle, during which one cigarette of the stack occupying each channel 7 will be positioned alongside the relative hole 16.

In the event that a cigarette 2 is found to be defective, the monitoring device 15 will trigger a signal to eject that cigarette, by way of a conventional memory device not illustrated).

More particularly, following a delay commensurate with the difference in height between the monitoring device 15 and the eject station 17, calculated in terms of machine cycles, the ejection device 18 will be duly activated to remove the substandard cigarette 2 from the chute 3.

As the cigarettes 2 descend through the channels 7, those lying above the sensors 15' are urged into contact with the right wall 6 of the chute 3 by the repeated movements of the retaining and positioning means 21, which therefore function, in effect, as a means of adjusting the alignment of the cigarettes 2 axially so that all are positioned identically in relation to the sensors 15'.

With each movement of the retaining and positioning means 21, which occurs in such a way as to cause no impediment to the intermittent descent of the relative stack of cigarettes, the effect achieved (besides retaining, positioning and adjusting the alignment of the stack) is to reduce or eliminate the force with which cigarettes 2 lying above the eject station 17 bear down on a cigarette currently occupying the station, at the moment appointed for the relative pneumatic extraction duct 19 to come into operation.

In a preferred embodiment, the projecting ends of the bristles 24 carried by the support 22 continue to encroach marginally on the channel 7 even as the stack of cigarettes 2 descends, thereby maintaining the right ends of the cigarettes 2 in contact with the respective wall 6 but without affecting the descent of the stack.

What is claimed is:

1. A device for longitudinally, horizontally feeding successive rows of nominally like-sized cigarettes all arranged with respective one ends oriented in one direction and opposite ends in an opposite direction, from the bottom of an infeed chute in which such cigarettes are stacked, comprising:

opposed vertical end walls and partition means defining a bottom-opening chute laterally divided near the bottom thereof into a plurality of channels each substantially equal in width to a single cigarette and each slightly longer than a single cigarette and equivalent to several cigarette diameters in height and in which said cigarettes are disposed in vertical stacks for intermittent descent;

intermittently operable means for transferring a respective lowermost row of cigarettes horizontally with said one ends forward, axially of respective longitudinal axes of such cigarettes, from an open bottom of said chute, while temporarily providing underlying support for a respective next uppermost row of said cigarettes;

sensing means associated with each channel of said chute at an intermediate level of said chute, for monitoring integrity of successive cigarettes occupying said intermediate level of said chute through respective one ends of said cigarettes;

an ejecting device associated with each channel of said chute at a respective lower level which is below said intermediate level and above said open bottom, for ejecting horizontally from said chute axially of respective longitudinal axes thereof cigarettes sensed by said sensing means as being defective;

means associated with one of said vertical end walls of said chute cyclically engaging said opposite ends of at least one cigarette in each said column only above said lower level, in synchronization with operation of said intermittently operable transferring means, for:

(a) urging respective cigarettes axially towards an opposite one of said vertical end wall means of said chute towards said sensing means; and (b) supporting respective overlying cigarettes for avoiding interference of such overlying cigarettes with operation of said ejecting device, said cyclically engaging means comprising a cyclically movable support, and resilient means extending from said support towards respective of said channels, and forming, when disposed in urging and supporting relation to said respective cigarettes, respective portions of said one vertical end wall means of said chute; and an actuator for cyclically moving said cyclically engaging means so as to alternatingly dispose said resilient means into and out of partially occluding relation with said channels in synchronization with operation of said intermittently operable transferring means, so as to permit intermittent descent by gravity of cigarettes in said columns.

2. The device of claim 1, wherein:

said resilient means are constructed by flexible bristles anchored at bases thereof to said movable support and having free ends disposed for resilient cyclical engagement with said opposite ends of said cigarettes in said columns.

3. The device of claim 2, wherein:

said bristles in a downward direction effectively increase in length and in degree of extension into said columns when cyclically urging and supporting respective ones of said cigarettes, and thereby simultaneously directly urge and support a plurality of cigarettes in each said column.

* * * * *